US005755360A

United States Patent [19]

Elliott

[11] Patent Number: 5,755,360

[45] Date of Patent: May 26, 1998

[54] MULTI-MATERIAL, MULTI-SHOT, INJECTION MOLDED DISPENSING CLOSURE HAVING A REMOVABLE SEAL

[75] Inventor: John Elliott, Burlington, Wis.

[73] Assignee: AptarGroup, Inc., Crystal Lake, Ill.

[21] Appl. No.: 678,162

[22] Filed: Jul. 11, 1996

[51] Int. Cl.[6] ..... B67B 5/00

[52] U.S. Cl. ..... 222/153.07; 264/255

[58] Field of Search ..... 222/153.07, 556, 222/541.9; 264/255, 241

[56] References Cited

U.S. PATENT DOCUMENTS

| | | |
|---|---|---|
| Re. 29,850 | 11/1978 | Labarre . |
| 2,705,085 | 3/1955 | Glensky . |
| 2,895,654 | 7/1959 | Rieke . |
| 3,135,441 | 6/1964 | Wise et al. . |
| 3,160,327 | 12/1964 | Porcelli . |
| 3,207,375 | 9/1965 | Bereziat et al. . |
| 3,223,298 | 12/1965 | Roberson et al. . |
| 3,239,112 | 3/1966 | Porcelli . |
| 3,269,617 | 8/1966 | Goth . |
| 3,278,089 | 10/1966 | Heekin et al. . |
| 3,282,477 | 11/1966 | Henchert . |
| 3,310,206 | 3/1967 | Littlefield . |
| 3,419,181 | 12/1968 | Stec . |
| 3,434,620 | 3/1969 | Laurizio . |
| 3,458,080 | 7/1969 | Laurizio . |
| 3,459,315 | 8/1969 | Labarre . |
| 3,483,355 | 12/1969 | Murdock . |
| 3,495,746 | 2/1970 | Laurizio . |
| 3,567,061 | 3/1971 | Song . |
| 3,604,585 | 9/1971 | Towns . |
| 3,610,484 | 10/1971 | Matzka . |
| 3,661,306 | 5/1972 | Kuckens . |
| 3,734,333 | 5/1973 | Foss . |
| 3,758,000 | 9/1973 | Mack . |
| 3,817,416 | 6/1974 | Costa . |
| 3,823,841 | 7/1974 | Lovejoy . |
| 3,834,597 | 9/1974 | Guala . |

(List continued on next page.)

FOREIGN PATENT DOCUMENTS

| | | |
|---|---|---|
| 553753 | 1/1957 | Belgium . |
| 0 570 276 A1 | 5/1993 | European Pat. Off. . |
| A1 0 570 276 | 11/1993 | European Pat. Off. . |
| 0 442 379 B1 | 1/1995 | European Pat. Off. . |
| 0 778 219 A2 | 11/1997 | European Pat. Off. . |
| 1126495 | 7/1956 | France . |
| 79 06608 | 3/1979 | France . |
| 82 05907 | 4/1982 | France . |
| 27 55 136 | 12/1977 | Germany . |
| 1217145 | 12/1970 | United Kingdom . |
| 222 064 | 5/1979 | United Kingdom . |
| 2 041 896 | 1/1980 | United Kingdom . |
| WO 95/28274 | 10/1995 | WIPO . |
| WO96/24483 | 8/1996 | WIPO . |

OTHER PUBLICATIONS

"Multi-Material Injection Saves Time, While Cutting Costs," Modern Plastics, Mar. 19, 1994 (Author: Peter Mapleston).

"Molding Many Parts Into One," Product Design and Development, Dec. 19, 1995, p. 16 (Author: Jay Rosenberg).

*Primary Examiner*—Gregory L. Huson

*Attorney, Agent, or Firm*—Rockey, Milnamow & Katz, Ltd.

[57] ABSTRACT

A closure is provided for a container and includes a base which preferably has an attached lid. The base includes a body for mounting to the container, and the body defines a dispensing orifice and spout. A tamper-evident seal initially closes the dispensing orifice. The body is injection molded from a first material. The tamper-evident seal structure is subsequently injection-molded from a second material. The seal structure includes a peripheral portion molded against the base body and attached thereto. The seal structure includes a partition consisting only of the second material extending across the dispensing orifice and connected around its periphery to the seal structure peripheral portion with a frangible, reduced thickness section of the second material. A grip member extends from the partition for being pulled to tear only the partition and grip member together away from the seal structure peripheral portion so as to open the dispensing orifice.

14 Claims, 3 Drawing Sheets

U.S. PATENT DOCUMENTS 3,860,152 1/1975 Marti .
4,022,357 5/1977 Dwinell .
4,179,044 12/1979 Fitte .
4,201,209 5/1980 LeVeen et al. ..... 264/255 X
4,294,382 10/1981 Summers et al. .
4,344,545 8/1982 Aschberger .
4,350,261 9/1982 Roth .
4,356,939 11/1982 Fitte .
4,369,888 1/1983 Walter .
4,371,089 2/1983 Barendregt .
4,440,310 4/1984 Heyn .
4,442,949 4/1984 Dwinell et al. .
4,452,382 6/1984 Holdt .
4,453,646 6/1984 Harrild .
4,512,486 4/1985 Kobayashi et al. .
4,523,691 6/1985 Larkin et al. .
4,533,062 8/1985 Krautkramer .
4,568,005 2/1986 Jalovec et al. .
4,682,702 7/1987 Gach .
4,699,290 10/1987 Adams .
4,724,977 2/1988 Cleevely et al. .
4,724,978 2/1988 Cleevely et al. .
4,724,979 2/1988 Cleevely et al. .
4,727,999 3/1988 Gach .
4,746,025 5/1988 Krautkramer .
4,747,498 5/1988 Gach .
4,782,964 11/1988 Poore et al. .
4,795,044 1/1989 Beck .
4,807,769 2/1989 Gach .
4,815,618 3/1989 Gach .
4,817,807 4/1989 Hummer .
4,819,819 4/1989 Robertson, Jr. .
4,869,399 9/1989 Dubach .
4,948,003 8/1990 Munoz .
4,948,015 8/1990 Kawajiri et al. .
5,008,066 4/1991 Mueller .
5,133,486 7/1992 Moore et al. .
5,199,618 4/1993 Reil et al. .
5,439,124 8/1995 Mock .
5,439,143 8/1995 Brown .
5,503,282 4/1996 Montgomery .
5,662,245 9/1997 Grant ..... 222/153.07

MULTI-MATERIAL, MULTI-SHOT, INJECTION MOLDED DISPENSING CLOSURE HAVING A REMOVABLE SEAL

TECHNICAL FIELD

This invention relates to container closures. The invention is more particularly related to a sealed, tamper-indicating, dispensing closure which is especially suitable for use with a squeeze-type container wherein a fluid product can be discharged from the container through the opened dispensing closure when the container is squeezed.

BACKGROUND OF THE INVENTION

AND

TECHNICAL PROBLEMS POSED BY THE PRIOR ART

Various product packaging designs employ barriers or seals across an opening to the package. Such seals can serve as primary or secondary barriers to contaminant ingress. Such seals may also maintain product freshness. In addition, such seals may provide a tamper-indicating function wherein breaking or removing the seal provides evidence that the package has been opened.

Examples of a closure with an internal tamper-indicating seal are disclosed in U.S. Pat. Nos. 4,948,003 and 4,807,769. These types of closures include a base for mounting the closure to the container. The base includes a pour spout. The pour spout is initially occluded by a sealing disk or member. The periphery of the sealing disk defines a reduced cross-sectional thickness of material which functions as a frangible web connecting the sealing disk to a radially outward region of material. An exterior portion of the sealing disk may include a pull tab which is grasped by a user's fingers for ripping the sealing disk out of the pour spout. The closure also includes a hinged lid with an internal collar to telescopically receive the pour spout in sealing engagement when the lid is closed so as to provide a liquid-tight and air-tight system after the sealing disk has been removed.

While closures of the above-discussed type may function generally satisfactorily in applications for which they are intended, it would desirable to provide an improved closure with enhanced features. For example, in some applications it might be desirable to provide a closure which could be produced by multi-shot, multi-material injection molding. Then the sealing member could be molded from one material, and the closure base could advantageously be molded from another material having certain other desirable characteristics (e.g., strength, greater hardness, etc.).

For example, a typical body material may have characteristics that are not compatible with the desired operation of a unitary molded sealing member. That is, some materials that would be useful for an exterior closure body may not have characteristics that accommodate relatively easy tearing for seal removal.

Further, while some materials may have strength or hardness characteristics desirable for a closure body, such materials may not be as compatible with the container product as would be desired.

Also, a strong closure body material might have undesirably high gas permeability characteristics that would reduce the effectiveness of the material as a seal.

Accordingly, it would be desirable to provide an improved injection molding system for closures and an improved closure for accommodating the injection molding of different materials for the body and sealing member. Such an improved closure should preferably include a seal member structure wherein an internal seal portion could be readily opened by the user.

Such an improved closure should advantageously provide a tamper-indicating means for visually indicating that the seal has been opened.

It would also be beneficial if such an improved closure could accommodate the use of a variety of seal materials in conjunction with a variety of different closure body materials.

Also, it would be desirable if such an improved closure could be provided with a design that would accommodate efficient, high quality, large volume manufacturing techniques with a reduced product reject rate.

Further, such an improved closure should advantageously accommodate its use with a variety of conventional containers having a variety of conventional container finishes, such as conventional threaded or snap-fit attachment configurations.

The present invention provides an improved closure which can accommodate designs having the above-discussed benefits and features.

SUMMARY OF THE INVENTION

According to the present invention, an improved dispensing closure is provided for an opening to a container interior. The closure includes a tamper-indicating seal which is easily manipulated by the user to open the seal. Preferably, a lid is also provided with an optional re-sealing collar for resealing the opening.

The improved closure permits one material to be used for the closure body and a different, more easily tearable, material to be used for the closure seal.

The closure includes a base. The base includes a body that is injection-molded from a first material for mounting to the container around the opening. The base body includes an end that defines a dispensing orifice for communicating with the container opening and that defines a pour spout.

The base also includes a tamper-evident seal structure subsequently injection molded from a second material. The seal structure includes a peripheral portion molded against at least a portion of the base body end and attached thereto. The seal structure includes a partition consisting of the second material extending across the dispensing orifice. The partition is connected around its periphery to the seal structure peripheral portion with a frangible, reduced thickness section of the second material. The seal structure includes a grip member extending from the partition for being pulled to tear only the partition and grip member together away from the seal structure peripheral portion so as to open the dispensing orifice.

A lid is preferably provided for occluding the dispensing orifice in a closed position over the base body. The lid can be moved away from the closed position to permit the dispensing of the container stored contents out of the orifice.

According to another aspect of the invention, a method is provided for making the dispensing closure. The method includes the step of injection molding a first material to form the body that mounts over the container around the opening and that has an end defining (1) a dispensing orifice for communicating with the container opening, and (2) a pour spout.

The next step of the method includes the subsequent injection molding of a tamper-evident seal structure from a second material to include (1) a peripheral portion molded against the body end, (2) a partition that extends across the dispensing orifice and that is connected around its periphery with a frangible, reduced thickness section of the second material to the peripheral portion, and (3) a grip member extending from the partition for being pulled to tear only the partition and grip member together away from the peripheral portion to open the dispensing orifice.

The method includes the step of attaching the seal structure peripheral portion to the body during the injection molding process.

The method preferably also includes the molding of a lid for occluding a dispensing orifice in a closed position over the body and for being moved away from the closed position to permit the dispensing of the container-stored contents out of the orifice.

In a preferred embodiment, the closure body and lid are molded together as a unitary structure with a hinge connecting the lid to the body to accommodate movement between a closed position covering the body and an open position in which the body is uncovered.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure components of this invention are described in various positions, and terms such as upper, lower, horizontal, etc., are used with reference to these positions. It will be understood, however, that the closure components may be manufactured and stored in orientations other than the ones described.

Figure 1:
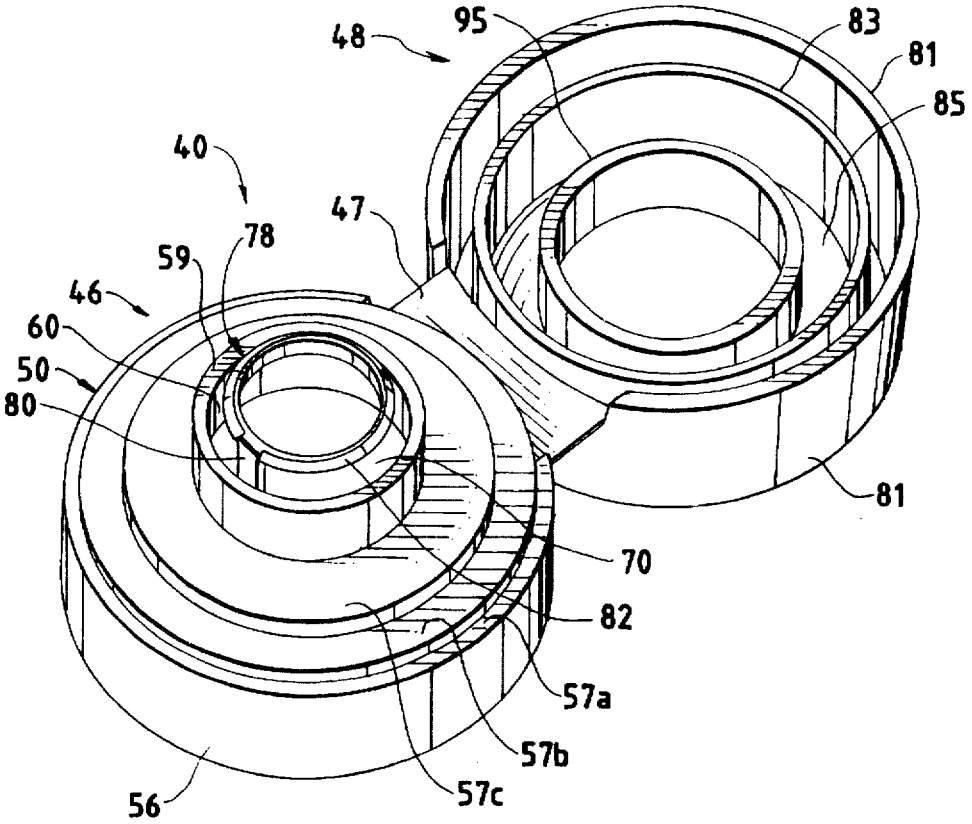
FIG. 1 is a perspective view of a first embodiment of a closure of the present invention shown with the lid open.
Figure 2:
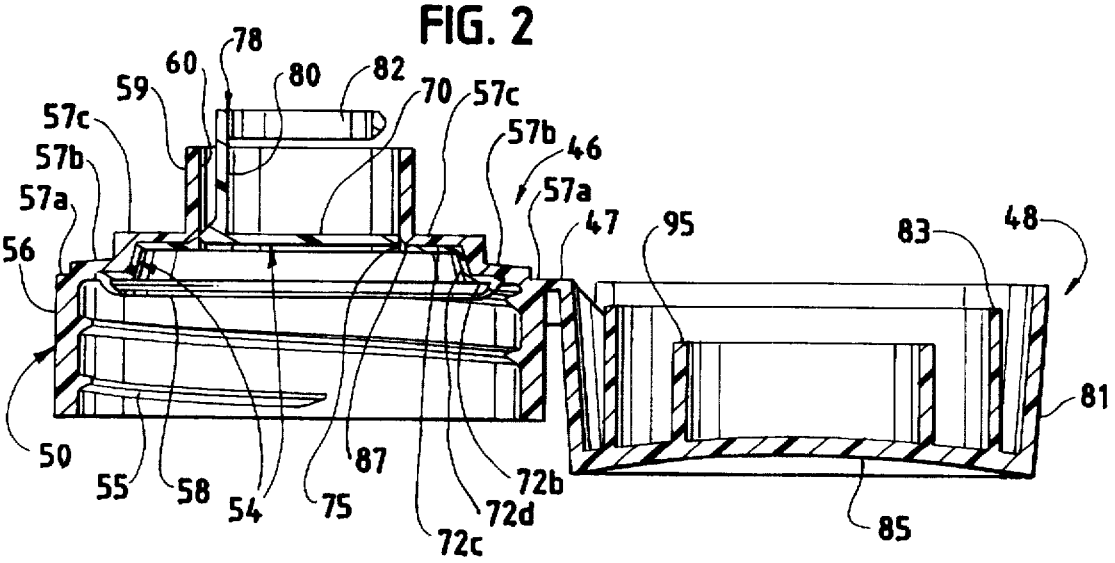
FIG. 2 a cross-sectional view of the closure shown in FIG. 1.

With reference to the figures, a first embodiment of a closure of the present invention is illustrated in FIGS. 1 and 2 and is represented generally in the figures by reference numeral 40. The closure 40 is adapted to be disposed on a container (not shown) which has a conventional mouth or opening (not visible) formed by a neck or other suitable structure (not shown). The neck typically has (but need not have) a circular cross-sectional configuration, and the body of the container may have another cross-sectional configuration, such as an oval cross-sectional shape, for example.

The container may typically be a squeezable container having a flexible wall or walls which can be grasped by the user and compressed to increase the internal pressure within the container so as to squeeze the product out of the container through the closure when opened. The container wall typically has sufficient, inherent resiliency so that when the squeezing forces are removed, the container wall returns to its normal, unstressed shape.

The closure 40 includes a base 46 and preferably includes a lid 48. The base 46 is injection-molded from two different materials, such as thermoplastic materials compatible with the container contents. The base 46 includes a body 50 molded from a first material and a seal structure 54 molded from a second material (FIG. 2).

In the first embodiment illustrated in FIGS. 1 and 2, the body 50 includes an annular skirt or wall 56 which may have suitable connecting means (e.g., a conventional thread 55 or conventional snap-fit bead (not illustrated)) for engaging suitable cooperating means, such as a thread or bead on the container neck (not shown) to secure the closure base 46 to the container. The closure base body 50 and container could also be welded together by induction melting or ultrasonic melting.

Near the top of the annular wall 56, the closure body 50 has a deck comprising a first, most outwardly, annular shoulder **57*a*, a second, somewhat higher annular shoulder 57*b*, and third, most inwardly, annular shoulder 57*c* which is higher than the shoulder 57*b*. The inner radius of the third shoulder 57*c* terminates in a frustoconical seating surface 97 and an upwardly extending, annular, tubular spout 59 defining a discharge aperture or orifice 60** over the container neck opening.

The base seal structure 54 is a layer, film, or membrane of material which is different than the material from which the body 50 is made. The seal 54 includes a generally disk-like central partition 70 occluding the dispensing orifice 60 of the closure base body spout 59. The seal structure 54 also includes outwardly extending, offset, peripheral portions **72*b* and 72*c* adjacent the interior surfaces of the deck shoulders 57*b* and 57*c*, respectively. In the embodiment illustrated in FIGS. 1 and 2, the seal 54 extends along the inside surface of the body 50 with a frusto-conical wall 72*d* connecting the portions 72*b* and 72*c***.

Preferably, an annular, flexible "crab's claw" shaped seal 58 (FIG. 2) projects downwardly from the seal portion **72*b* and is received against the upper edge of the container neck (not shown) adjacent the container neck opening so as to provide a leak-tight seal between the closure base 46 and the container neck. Of course, other types of closure base/container seals may be employed as described in detail hereinafter. Also, if air-tightness is not required, no closure base/container seal 58** need be employed.

As best seen in FIG. 2, the seal structure 54 includes a frangible, reduced thickness section of the seal material connecting the periphery of the central partition 70 to the seal structure peripheral portion (i.e., directly to the annular portion **72*c* which is part of the entire peripheral portion of the seal that also includes the frustoconical wall 72***d*, the flat annular portion 72*b*, and the crab's claw seal 58). The frangible, reduced thickness section of material is defined by an annular notch or groove 75 which opens downwardly around the periphery of the central partition 70 (FIG. 2).

The seal structure 54 also includes a grip member 78 which preferably comprises a tab 80 extending upwardly from the partition 70 and a pull ring 82 extending from the top of the tab 80. The user can insert a finger through the pull ring 82 for exerting an upwardly directed pulling force on the partition 70 so as to tear the partition away around the frangible, reduced thickness section of material defined by the notch 75. This opens the sealed spout dispensing orifice 60 and provides visual evidence that the closure has been opened.

In a preferred embodiment, the closure base body 50 is molded from a first material, such as polypropylene, and the seal structure 54 is molded from a second material, such as polyethylene. Preferably, a multi-shot injection molding process is used to first mold the closure base body 50 (and lid 48 if unitary with the body 50) as a "preform" in a first injection phase in a mold. The preform of the closure base body 50 is then automatically transferred to a second, differently shaped cavity in the same mold wherein the second material (e.g., polyethylene) is injection-molded (over-molded) in a second phase onto and against portions of the closure base body or preform to form the seal structure 54. The seal structure 54 is preferably attached to the closure base body 50 by the creation of a weld defined by the interface solidification of melted portions of the first and second materials. Alternatively, or in addition, the first and second material may be injection-molded so as to define a mechanical interlock of the materials.

Descriptions of multi-shot, multi-material injection molding techniques are set forth in "Multi-Material Injection Saves Time, While Cutting Costs," MODERN PLASTICS, Mar. 19, 1994 (author: Peter Mapleston), in "Molding Many Parts Into One," Product Design and Development, Dec. 19, 1995, page 16 (author: Jay Rosenberg), and in U.S. Pat. No. 5,439,124.

The use of polyethylene for injection molding the seal structure 54 is advantageous in many applications because polyethylene provides a relatively good oxygen barrier which prevents oxygen migration through the seal into the container. This is especially useful for closures on containers containing food. Additionally, polyethylene provides the desired tear characteristics that accommodate opening of the seal structure 54 as described in detail hereinafter.

The closure lid 48 may be an entirely separate piece unconnected to the closure base 46. Preferably, a hinge 47 is provided for connecting the lid 48 to the body base 46 to form a unitary structure. The hinge may be a floppy hinge or a snap-action hinge.

The lid 48 includes a concave, top wall 85, an outer skirt or wall 81, and an inner wall 83. As illustrated in FIG. 2, the lid outer wall 81 is adapted to seat on an annular shoulder 57*a* defined at the top of the closure base body sidewall 56. The lid inner wall 83 is designed to be located on top of the closure base body annular shoulder 57*b*.

An annular sealing collar 95 extends from the top wall 85. The collar 95 is spaced radially inwardly from the inner wall 83 for sealingly engaging the exterior of the spout 59 when the lid 48 is closed.

When the user desires to dispense product from the container through the closure 40, the user lifts the lid 48 away from the spout 59. When the lid 48 is moved far enough away from the spout 59, the product may be discharged from the container through the spout 59 by squeezing the container. When it is again desired to close the container, the lid 48 is moved back onto the base 46.

Figure 3:
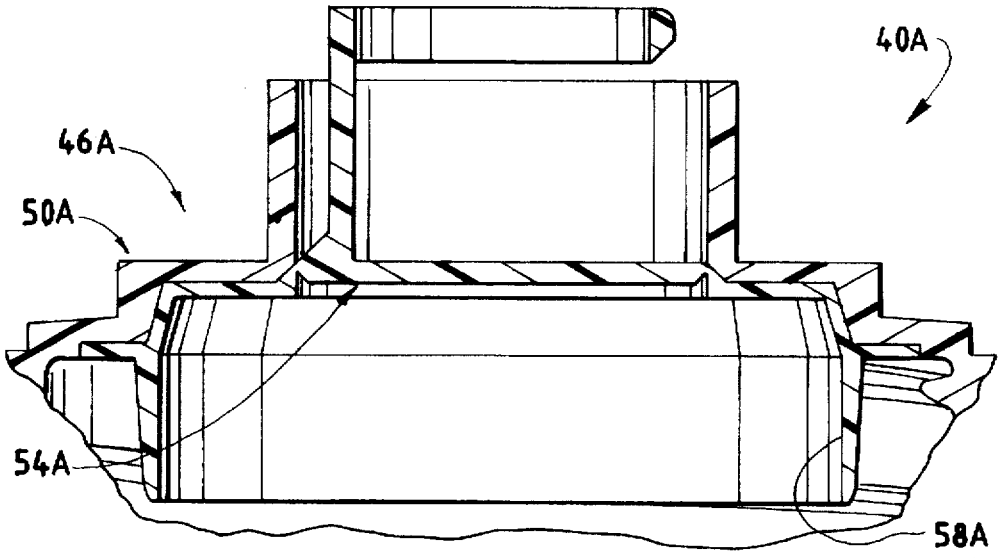
FIG. 3 is an enlarged, cross-sectional view similar to FIG. 2, but FIG. 3 shows a second embodiment of the closure.

FIG. 3 illustrates a second embodiment of the closure 40A. The closure 40A includes a closure base 46A. The base 46A includes a body 50A which is identical with the body 50 of the first embodiment of the closure described above with reference to FIGS. 1 and 2. The closure 40A includes a lid (not visible in FIG. 3) which may be identical with the lid 48 described above with reference to FIGS. 1 and 2 illustrating the first embodiment of the closure 40.

The second embodiment of the closure base 46A includes a seal structure 54A. The seal structure 54A is identical with the seal structure 54 described above with reference to the first embodiment illustrated in FIGS. 1 and 2, except that the second embodiment seal structure 54A includes a downwardly extending, annular plug seal 58A instead of the smaller, "crab's claw" seal 58 employed in the first embodiment closure seal structure. The plug seal 58A is adapted to be received in the opening of a container neck for sealing against the interior cylindrical surface of the container neck.

Figure 4:
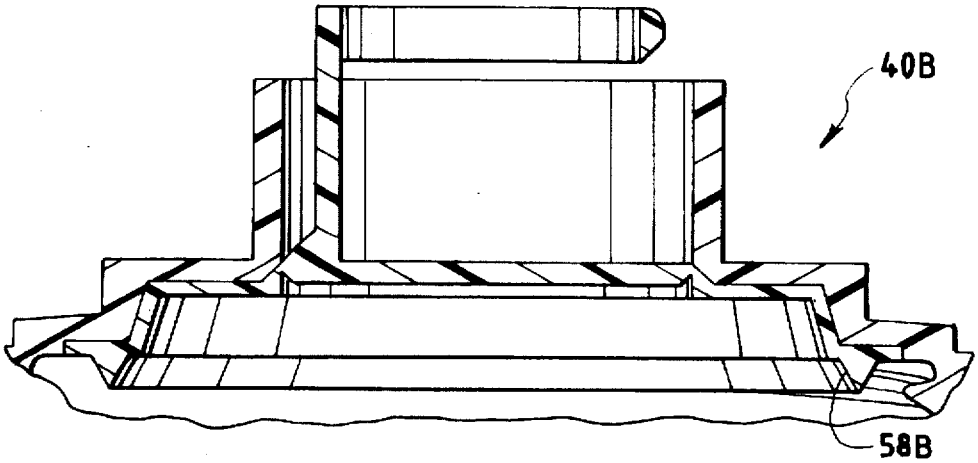
FIG. 4 is a view similar to FIG. 3, but FIG. 4 shows a third embodiment of the closure.

FIG. 4 illustrates a third embodiment of the closure 40B. The closure 40B has substantially the same structure as the first two embodiments of the closure illustrated in FIGS. 1–3, except that the third embodiment of the closure 40B includes a V-shaped seal 58B instead of a "crab's claw" seal 58 (FIG. 2) or a plug seal 58A (FIG. 3).

Figure 5:
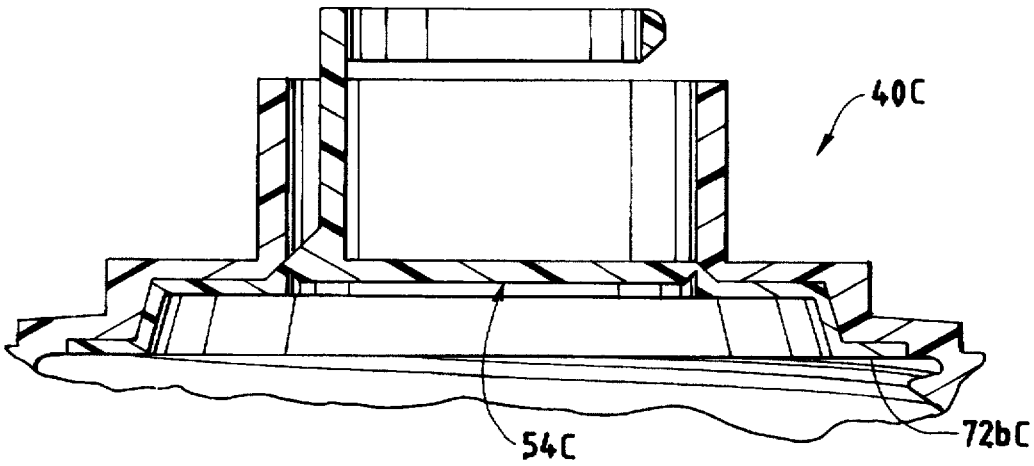
FIG. 5 is a view similar to FIG. 3, but FIG. 5 shows a fourth embodiment of the closure.

FIG. 5 illustrates a fourth embodiment of the closure designated generally therein by the reference numeral 40C. The closure 40C includes a seal structure 54C substantially identical with the seal structure 54A of the second embodiment illustrated in FIG. 3, except that the fourth embodiment seal structure 54C has no downwardly projecting container seal at all. Rather, the top of the container neck is sealed by the bottom surface of the outermost peripheral portion 72*b*C.

Figure 6:
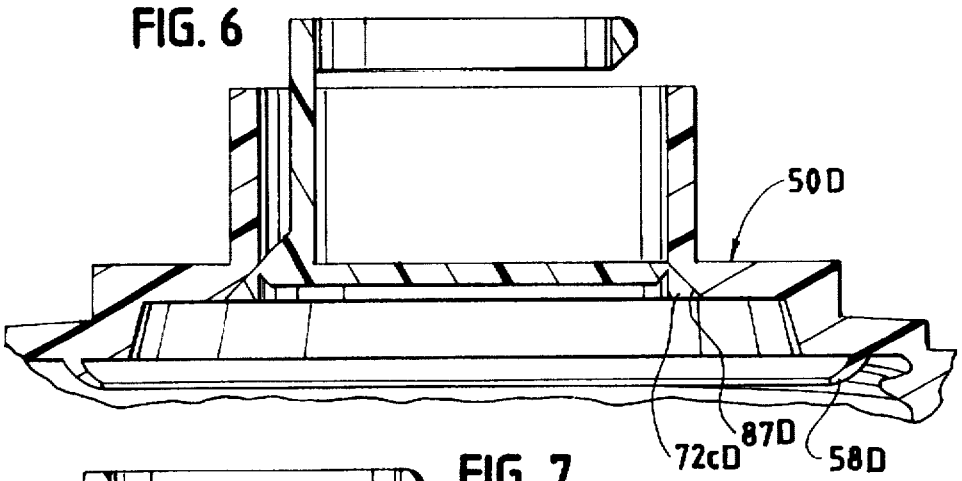
FIG. 6 is a view similar to FIG. 3, but FIG. 6 shows a fifth embodiment of the closure.

FIGS. 6–9 show various designs for molding portions of the seal structure against the closure base body. In particular, FIG. 6 illustrates a fifth embodiment of a closure having a base body 50D defining a frustoconical seating surface 87D for receiving the orifice seal structure peripheral portion 72*c*D which has a triangular cross-sectional shape. The body 50D includes a "crab's claw" type container seal 58D outwardly of the orifice seal peripheral portion 72*c*D.

Figure 7:
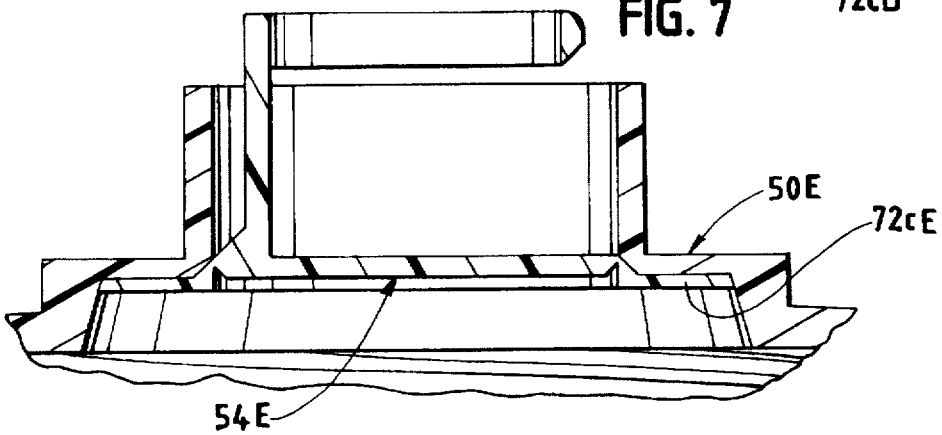
FIG. 7 is a view similar to FIG. 3, but FIG. 7 shows a sixth embodiment of the closure.

FIG. 7 illustrates a sixth embodiment of the closure having a base body 50E and a seal structure 54E. The seal structure 54E has a peripheral portion 72*c*E which extends radially outwardly further than the portion 72*c*D described above with reference to the fifth embodiment illustrated in FIG. 6.

Figure 8:
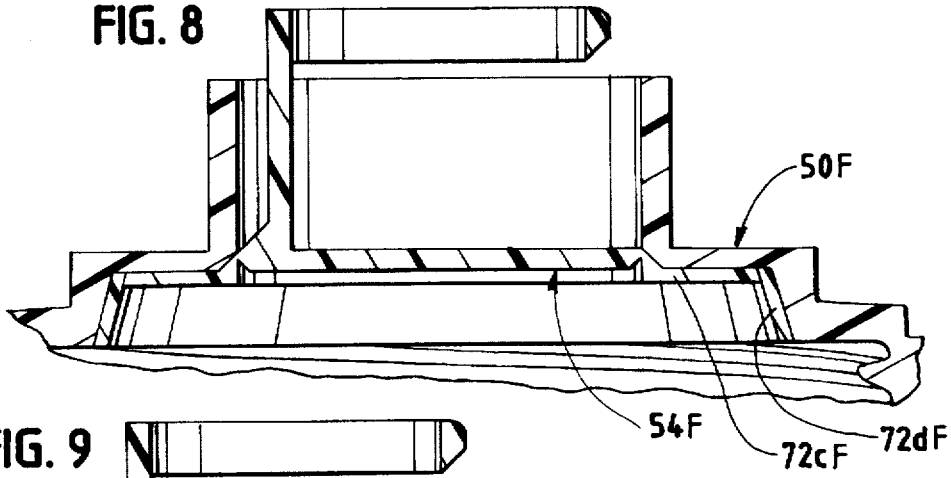
FIG. 8 is a view similar to FIG. 3, but FIG. 8 shows a seventh embodiment of the closure.

In FIG. 8, a seventh embodiment of the closure includes a base body 50F having a seal structure 54F. The seal structure 54F has a first peripheral portion 72*c*F and another, angled peripheral portion 72*d*F.

Figure 9:
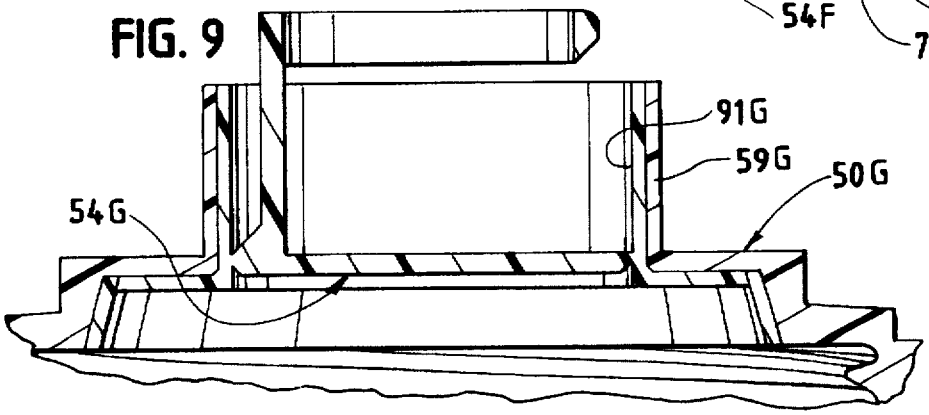
FIG. 9 is a view similar to FIG. 3, but FIG. 9 shows an eight embodiment of the closure.

FIG. 9 illustrates an eighth embodiment of the closure having a base body 50G and a seal structure 54G. The seal structure 54G includes the same structural portions as does the seal structure 54F described above with reference to the seventh embodiment illustrated in FIG. 8. In addition, the eighth embodiment seal structure 54G includes an upwardly extending annular wall 91G which is molded against the interior cylindrical surface of the closure spout 59G.

In all of the embodiments illustrated in FIGS. 6–9, the seal structure peripheral portion is attached to the base body, preferably by means of a weld defined by the interface solidification of melted portions of the closure body and seal structure. However, alternatively, or in addition, the closure body and seal structure may be attached with mechanical engaging structures formed as a result of a two-shot, two-material injection molding of the closure body first material and closure seal structure second material.

It will be appreciated that other modifications may be incorporated in the closure design. For example, the seal structure partition (such as the partition 70 in the first embodiment illustrated in FIGS. 1 and 2) may be provided at a different elevation within the closure body. The partition, and the peripheral frangible web, may be located further up the spout 59, or even below the spout. For example, if the seal structure includes a tubular wall such as the wall 91G illustrated in the embodiment shown in FIG. 9, then the central partition portion of the seal structure 54G could be located even at the top of the wall 91G adjacent the distal end of the spout 59G. The tear ring 82 and tab 80 may extend completely out of the spout 60.

In another embodiment, the spout 60 may be so short as to be defined essentially by just the thickness of the body deck (e.g., annular shoulder 57C (FIG. 2)).

Further, the seal structure partition (such as the partition 70 illustrated in FIGS. 1 and 2) need not be oriented horizontally or parallel to the closure top and bottom planes. Rather, if desired, the partition 70 could be formed at an angle (e.g., 60 degrees relative to a longitudinal axis defined by the cylindrical spout 59).

The closure of this invention readily accommodates fabrication of the closure seal from a material different from the closure body material. This permits optimization of the body material and seal material to better accommodate their different functions.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing closure for an opening to a container interior, said closure comprising:

a base;

said base including a body injection molded from a first material for mounting to said container around said opening, said base body including an end that defines a dispensing orifice for communicating with said container opening and that defines a pour spout; and said base including a tamper-evident seal structure subsequently injection molded from a second material, said seal structure including a peripheral portion molded against said base body end and attached thereto, said seal structure including a partition consisting of said second material extending across said dispensing orifice and connected around its periphery with a frangible, reduced thickness section of said second material to said seal structure peripheral portion, said seal structure including a grip member extending from said partition for being pulled to tear only said partition and grip member together away from said seal structure peripheral portion to open said dispensing orifice.

2. The closure in accordance with claim 1 further including a lid for occluding said dispensing orifice in a closed position over said base body and for being moved away from said closed position to permit the dispensing of container-stored contents out of said orifice.

3. The closure in accordance with claim 1 in which said body consists only of said first material;

said seal structure partition and peripheral portion consist only of said second material; and said peripheral portion is attached to said base body end with a weld defined by the interface solidification of melted portions of said first and second materials.

4. The closure in accordance with the claim 1 in which said first material is polypropylene and said second material is polyethylene.

5. The closure in accordance with claim 1 in which said body end defines a deck and said pour spout has a tubular configuration projecting from and above said deck.

6. The closure in accordance with claim 5 in which at least a part of said grip member is within said spout.

7. The closure in accordance with claim 5 in which said seal structure includes an annular wall molded against the interior surface of said spout.

8. A dispensing closure for an opening to a container interior, said closure comprising:

a base;

said base including a body injection molded from a first material for mounting to said container around said opening, said base body including an end that defines a dispensing orifice for communicating with said container opening and that defines a pour spout, said end including a deck defining at least (1) a frusto-conical seating surface around said orifice, (2) an inner annular shoulder around said seating surface, and (3) at least one outer shoulder that is radially outwardly of said inner shoulder and that is axially displaced from said inner shoulder toward said container; and said base including a tamper-evident seal structure subsequently injection molded from a second material, said seal structure including a peripheral portion molded against and attached at least to said base body (1) deck seating surface, (2) inner annular shoulder, and (3) outer annular shoulder, said seal structure including a partition consisting of said second material extending across said dispensing orifice and connected around its periphery with a frangible, reduced thickness section of said second material to said seal structure peripheral portion, said seal structure including a grip member extending from said partition for being pulled to tear only said partition and grip member together away from said seal structure peripheral portion to open said dispensing orifice.

9. The closure in accordance with claim 8 further including a lid for (1) being supported on said base body deck occluding said dispensing orifice in a closed position, and (2) for being moved away from said closed position to permit the dispensing of container-stored contents out of said orifice.

10. The closure in accordance with claim 8 in which said seal structure peripheral portion is attached to said base body deck with a weld defined by the interface solidification of melted portions of said first and second materials.

11. A method for making a dispensing closure for an opening to a container interior, said method comprising the steps of:

(A) injection molding a first material to form a body that mounts on said container around said opening and that includes an end that defines a dispensing orifice for communicating with said container opening and defines a pour spout;

(B) subsequently injection molding a tamper-evident seal structure from a second material to include (1) a peripheral portion molded against said body end, (2) a partition that extends across said dispensing orifice and that is connected around its periphery with a frangible, reduced thickness section of said second material to said peripheral portion, and (3) a grip member extending from said partition for being pulled to tear only said partition and grip member together away from said peripheral portion to open said dispensing orifice; and (C) effecting an attachment of said seal structure peripheral portion to said body.

12. The method in accordance with claim 11 further including the step of molding a lid for occluding said dispensing orifice in a closed position over said body and for being moved away from said closed position to permit the dispensing of container-stored contents out of said orifice.

13. The method in accordance with claim 11 in which step (C) includes effecting said attachment by creating a weld defined by the interface solidification of melted portions of said first and second materials.

14. The method in accordance with claim 11 in which step (C) includes effecting said attachment by molding said peripheral portion and body together to form a mechanical interlock.

* * * * *